US009593834B2

(12) United States Patent
Lee

(10) Patent No.: US 9,593,834 B2
(45) Date of Patent: Mar. 14, 2017

(54) HEAD LAMP DEVICE

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 0 days.

(21) Appl. No.: 14/807,893

(22) Filed: Jul. 24, 2015

(65) Prior Publication Data

US 2017/0023222 A1 Jan. 26, 2017

(51) Int. Cl.
*F21V 23/04* (2006.01)

(52) U.S. Cl.
CPC ..... *F21V 23/0492* (2013.01)

(58) Field of Classification Search
CPC ..... F21V 23/0492
USPC ..... 362/802, 103, 105, 106
See application file for complete search history.

(56) References Cited

U.S. PATENT DOCUMENTS

2012/0120636 A1* 5/2012 Wilt ..... A61B 90/11 362/105
2013/0039038 A1* 2/2013 Jones ..... A42B 3/044 362/106
2014/0362561 A1* 12/2014 Faircloth ..... G02C 11/04 362/103
2015/0016094 A1* 1/2015 Yamai ..... F21V 21/084 362/105

* cited by examiner

*Primary Examiner* — Laura Tso
(74) *Attorney, Agent, or Firm* — Guice Patents PLLC

(57) ABSTRACT

A head lamp device for wearing on a head and emitting lights outwardly is disclosed and comprises a cover member, a main control member, a sensing member, and at least two lamps. The main control member is mounted on the cover member. A receiving unit and a control unit are embedded in the main control member and electrically connected with each other wirelessly or wiredly. The sensing member is electrically connected with the main control member and installed in the cover member. The sensing member is detecting an inclined angle of the head and generating a signal for being transmitted to the main control member and received by the receiving unit. The lamps are electrically connected with the control unit. The lamps are controlled to turn on/off, adjust brightness, and change light-on/off priority by the control unit. The sensing member detects the change of the angle via moving the head.

7 Claims, 7 Drawing Sheets

HEAD LAMP DEVICE

BACKGROUND OF THE INVENTION

1. Field of the Invention

The present invention relates to a head lamp device, and especially relates to a head lamp device capable for wearing on a head and emitting lights outwardly for illumination according to the angle of head moving.

2. Description of Related Art

The lamp is one of the most important things for people in the technology generations. In early years, besides the lights emitted from the Sun, the candle is lighted on for illumination in the dark. In the recent years, the power may be provided for the lamp for illumination. People are benefited by the lamp very much. The lamp may be used for the land lamp, the flashlight, the vehicle light, the searchlight, and the reading lamp. The lamp is especially useful for illuminating in the dark so as to make the user see the environment clearly. Generally, the user may carry the flashlight for illumination by one hand. But for the workers in the construction site or at underground passage, it is not convenient for them while they are working with two hands. The strength and time are wasted. In order to improve the carry of the flashlight with one hand, the flashlight for illumination may be fastened at the clothes, the hat, the shoes, and etc. Therefore, the user (workers) may illuminate the environment with hands to keep working.

Please refer to Taiwan Patent No. M461744. An improved structure for head light is disclosed. A strap set has an arc-shaped ring section and an adjusting section. Two ends of the ring section are passing through the two ends of the adjusting section respectively. A cover set includes a cover body, a cover member, and a base body. The cover member is arranged at the front end of the cover body. The upper end of the base body and the cover body are pivoted with each other. The rear end of the base body is arranged at front of the ring section of the strap set. There are two lamps received in the cover body. The cover body has a concave surface and convex surfaces faced to the cover member for condensing and diffusing lights.

The above mentioned improved structure for head light is generally used for the user operated in the dark. After the head light is worn on the head of the user, the lamps in the cover body is used for illumination to decrease the dangers working in the dark. However, the user may move the head up or down to see the object while working but the position of the head light cannot follow the head to move. It still needs the hand(s) of the user to adjust or move the head light for illumination. Although it may achieve the effect of illumination, the user must waste time to adjust the head light with hand. Besides, the pivot is easy to be worn down after the head light is adjusted for a long time and with many times to result in the head light not capable for being adjusted anymore. Therefore, the head light must be replaced and still has many drawbacks to be improved.

In view of the foregoing circumstances, the inventor has invested a lot of time to study the relevant knowledge, compare the pros and cons, research and develop related products. After quite many experiments and tests, the "head lamp device" of this invention is eventually launched to improve the foregoing shortcomings, to meet the public use.

SUMMARY OF THE INVENTION

An object of this invention is providing a head lamp device for a user working in dark to change the illumination where the user wants to see. It may shorten the adjusting time by hand and make the loading of the head lighter. It may improve the dangers resulting from the operation with single hand of the prior art and the adjusting time for illumination.

In order to achieve above mentioned effects, a head lamp device for wearing on a head and emitting lights outwardly is provided. The head lamp device may comprise a cover member; a main control member, mounted in the cover member, a receiving unit and a control unit are embedded in the main control member, the receiving unit and the control unit are electrically connected with each other wirelessly or wired; a sensing member, electrically connected with the main control member and installed in the cover member, the sensing member is detecting an inclined angle of the head and generating a signal for being transmitted to the main control member and received by the receiving unit; and at least two lamps, electrically connected with the control unit of the main control member, the lamps are controlled to turn on, turn off, adjust brightness, and change light-on/light-off priority of the at least two lamps by the control unit after the receiving unit of the main control member receives the signal; wherein the sensing member is detecting the change of the inclined angle via moving the head.

The head lamp device may further comprise a high-beam detector for detecting a front light source and a low-beam detector mounted at the cover member, the high-beam detector and the low-beam detector are electrically connected with the receiving unit of the main control member, the high-beam detector and the low-beam detector are detecting the brightness of the light source in front of the head and generating a light-source information to transmit to the receiving unit for being received, the control unit controls the brightness of the lamps based on the light-source information and then the lights emitted from the lamps are changed to be diffused or condensed.

In some embodiments, the signal is an angle signal.

In some embodiments, the sensing member is a gyroscope, a level meter, or a G-sensor.

In some embodiments, the lamps are at the same height and arranged in parallel horizontally.

In some embodiments, the lamps are arranged in parallel vertically.

In some embodiments, at least one strap is connected to the peripheral of the cover member.

In conclusion, the head lamp device may be worn on user's head and moved with the head. The sensing member may detect the angle of head moving and transmit the information of the angle to the control unit of the main control member. The main control member may control the light emitted from each lamp while the head is moving. Therefore, one of the lamps or a plurality of lamps may emit lights for illumination corresponding to the angle of head moving while user's head is moving at any position with an angle. The lights may be kept illuminating forwardly and compensating enough lights for the user's seeing.

The various objectives and advantages of the present invention will be more readily understood from the following detailed description when read in conjunction with the appended drawing.

DETAILED DESCRIPTION OF THE INVENTION

Figure 1:
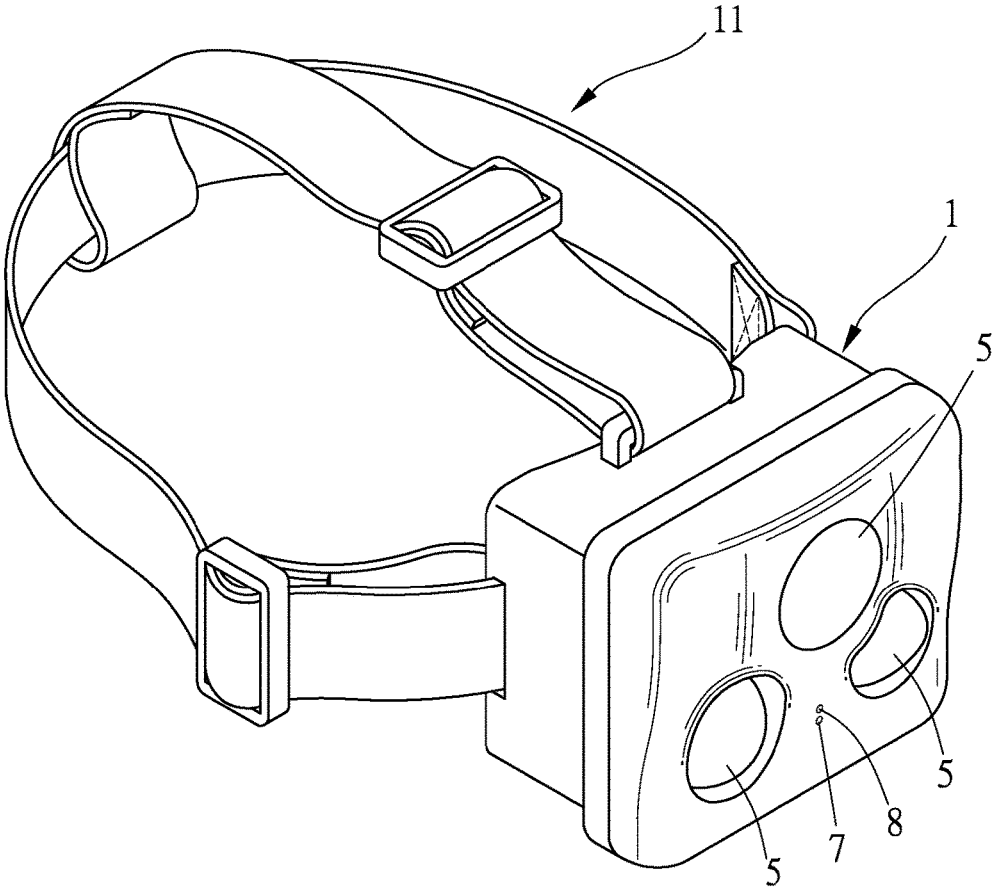
FIG. 1 is a perspective view of a head lamp device of the present invention.
Figure 2:
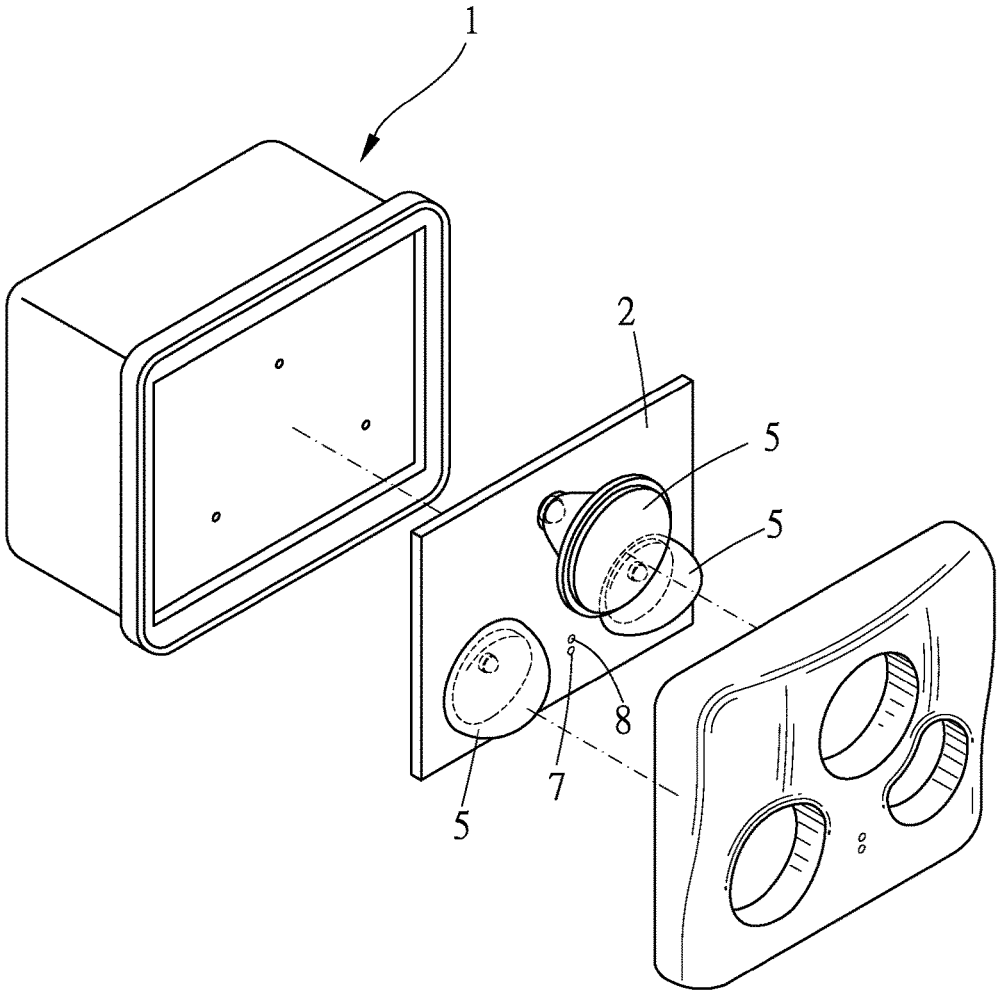
FIG. 2 is a partial cross-sectional view of the head lamp device of the present invention.
Figure 3:
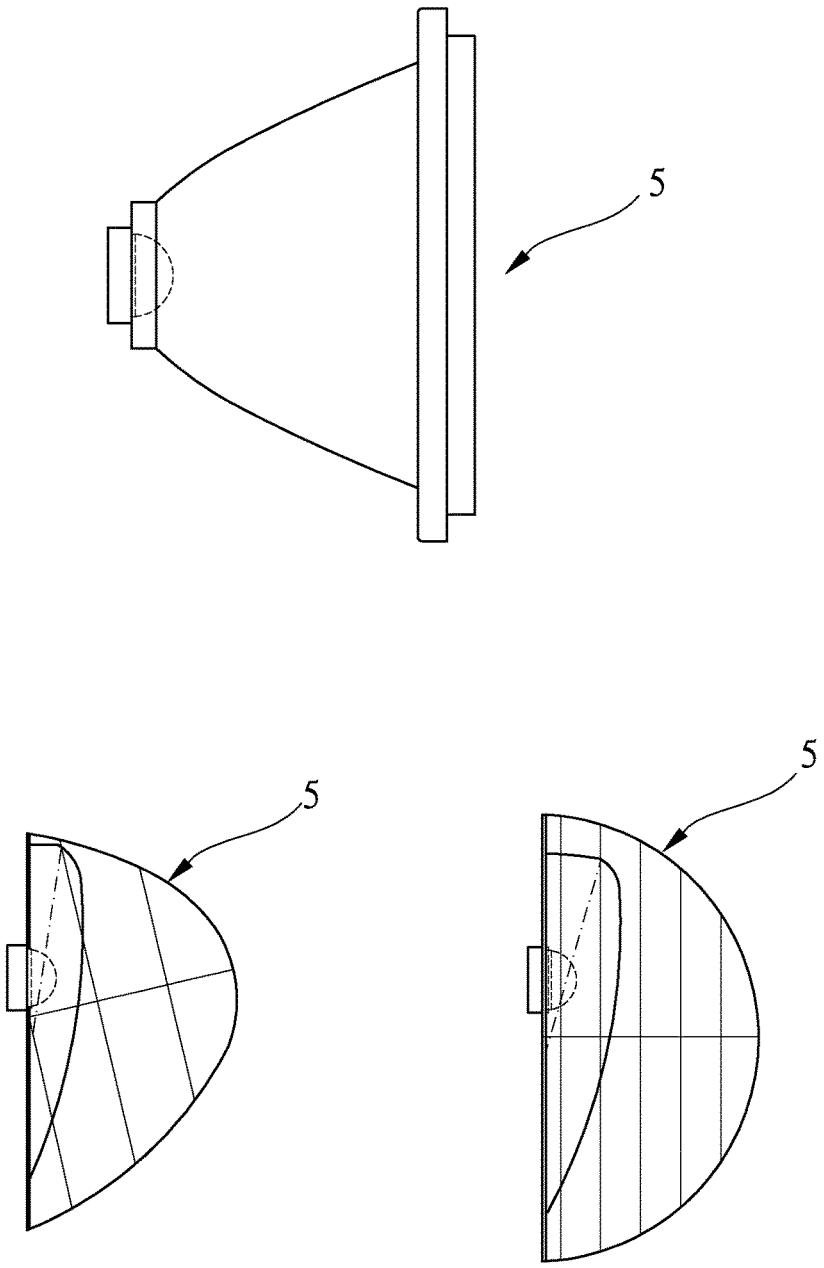
FIG. 3 is a side view of each lamp of the head lamp device of the present invention.
Figure 4:
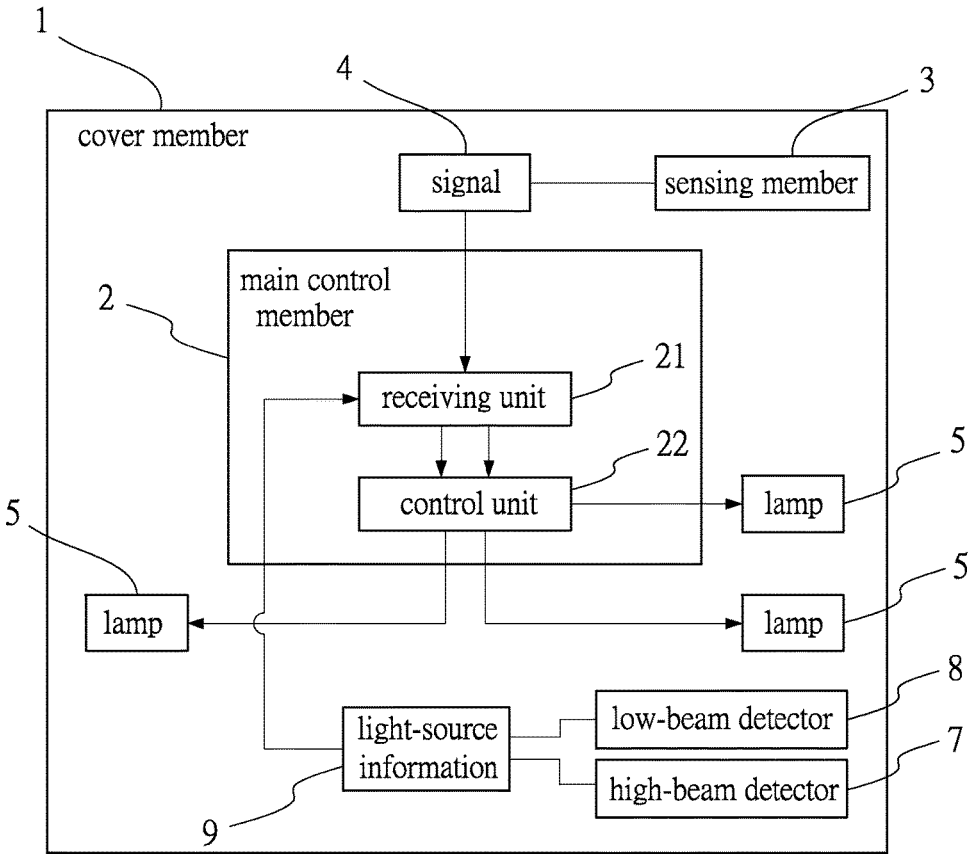
FIG. 4 is a block diagram of the head lamp device of the present invention.

To describe clearly that the present invention achieves the foregoing objective and function, the technical features and desired function are described with reference to a preferred embodiment and accompanying drawings.

Please reference to FIGS. 1 to 9, a head lamp device of present invention for wearing on a head and emitting lights outwardly may comprise a cover member 1, a main control member 2, a sensing member 3, and at least two lamps 5. At least one strap 11 may be connected to the peripheral of the cover member. The main control member 2 may be mounted in the cover member 1. A receiving unit 21 and a control unit 22 may be embedded in the main control member 2. The receiving unit 21 and the control unit 22 are electrically connected with each other wirelessly or wired. The sensing member 3 may be electrically connected with the main control member 2 and installed in the cover member 1. The sensing member 3 may be detecting an inclined and moving angle of the head and generating a signal 4 for being transmitted to the main control member 2 and received by the receiving unit 21. The lamps 5 may be electrically connected with the control unit 22 of the main control member 2. The lamps 5 may be controlled to turn on, turn off, adjust brightness, and change light-on/light-off priority of the lamps 5 by the control unit 22 after the receiving unit 21 of the main control member 2 receives the signal. The sensing member 3 may be detecting the change of the inclined and moving angle via moving and moving the head and further the main control member 2 controls light-on/light-off priority of the lamps 5.

The above mentioned embodiment is the main skill feature of this invention and corresponds to the claim 1 of this invention to understand the objective and embodiments of this invention in detail. And the skill features of the depending claims are for describing the claim 1 in detail or adding more skill features, but not limited thereto. It should be known that the claim 1 is not necessary to include the skill features of the depending claims.

When the user is in dark, the head lamp device of this invention is worn on the head of the user and the lamps 5 are controlled to turn on, turn off, and adjust brightness by moving head up and down and shifting head. It uses the cooperation of the sensing member 3 and the main control member 2. The sensing member 3 may detect the angle of head moving to produce a signal 4, the signal 4 is transmitted to the control unit 22, and then the lamps 5 are controlled to turn on, turn off, and adjust brightness by the control unit 22 according to the signal 4. Therefore, when the user is operating, the user may move head to control any one lamp 5 or a plurality of lamps 5 to be turned on, turned off, and adjusted brightness to keep lighting forwardly and cooperating with the eyes of the user. The light may be emitted to the target by moving head to control the illuminating change of each lamp 5 to achieve the best lighting effect.

Please reference to FIGS. 7 to 9, 1 and 2. The angles of moving head are different. The amount of the lamps 5 are at least two, but not limited thereto. The lamps 5 may be at the same height and arranged in parallel horizontally, or arranged in parallel vertically. The amount of the lamps 5 are three for illustration. The head is relative to the body at the same side. That is, the lamp 5 arranged at the top end is firstly emitting the light outwardly to illuminate when the head is not moving, and then the sensing member 3 may gradually detect the angle of head moving and the control unit 22 controls the lamp 5 arranged at the top end to turn off or decrease brightness and any one or two lamps 5 under the lamp 5 arranged at the top end are emitting lights to illuminate and each lamp 5 is controlled to be turned on, turned off, or adjusted brightness according to the angles of moving head when the head is moved downwardly. For example, the lamp 5 arranged at the top end is gradually decreased the brightness and the lamps 5 under the lamp 5 arranged at the top end are gradually increasing the brightness when the head is gradually moved downwardly. When the angle of moving head is between two lamps 5 which are turned on, the sensing member 3 may detect which lamp is closest to the angle for illumination and the control unit 22 may control one of the lamps 5 with full-light and other lamps 5 with half-light or full-light for compensation. Please reference to FIGS. 6 to 9, the different angles of moving head may control at least one lamp 5 with full-light or any one of the lamps 5 with full-light and the lamp 5 adjacent thereto with half-light or full-light for compensation. For example with data, when the angle of moving head is less than zero degree or between zero and five degree and the distance is ranged larger than 20 meters, the upper lamps 5 are emitting lights first. When the angle of moving head is between five and ten degree and the distance is ranged between ten and twenty meters, the upper lamps 5 and one of lower lamps 5 are emitting lights for illumination and the brightness of the upper lamps 5 is higher than the brightness of the lower lamp 5. When the angel of moving head is between eleven and twenty degree and the distance is ranged between five and ten meters, the lighting lamps 5 are the same as them whose distance is ranged between ten and twenty meters but the brightness of the upper lamps 5 are lower than the brightness of the lower lamp 5. When the angle of moving head is between twenty-one and thirty degree and the distance is ranged between three and five meters, the upper lamps 5 are turned off, two of the lower lamps 5 are turned on, and the brightness of one of the turn-one lower lamp 5 is higher than the brightness of the other. When the angle of moving head is larger than thirty degree and the distance is ranged between one and three meters, two of the lower lamps 5 are turned on but the brightness thereof is revered to the one whose distance is ranged between three and five meters to achieve the effect of various brightness for illumination. The user may move head to change the angle to make the lower two lamps 5 turn on or one of them when reading in dark (shown as in FIG. 8).

Figure 5:
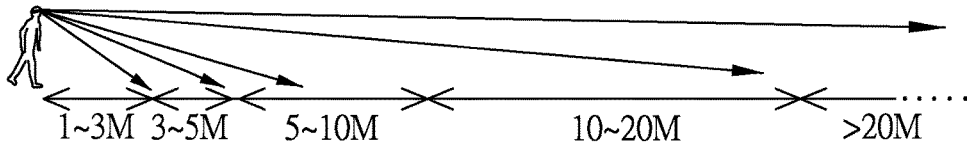
FIG. 5 is a perspective view of the head lamp device of the present invention for showing a lighting distance.
Figure 6:
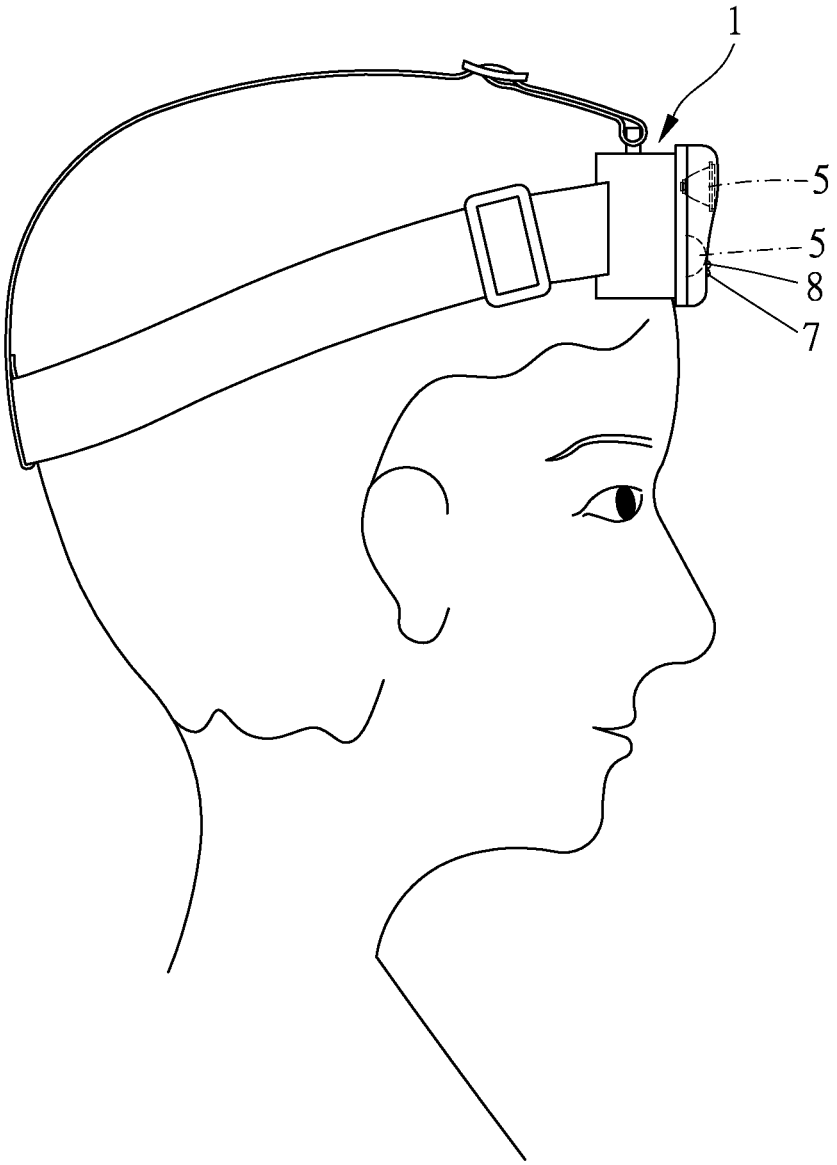
FIG. 6 is a perspective view of the head lamp device of the present invention while wearing on the head.
Figure 7:
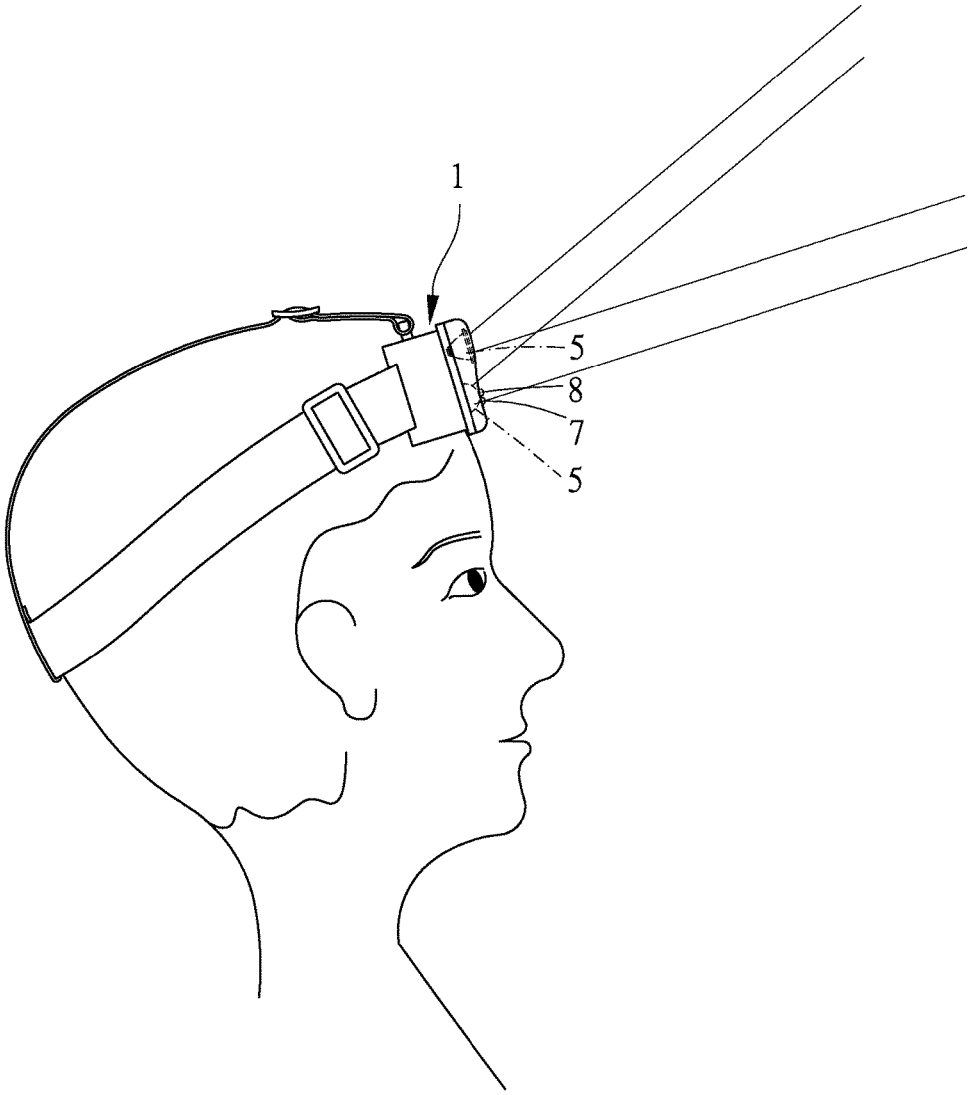
FIGS. 7 to 9 are the perspective views of the head lamp device of the present invention while the head moves at different angles for lighting.
Figure 8:
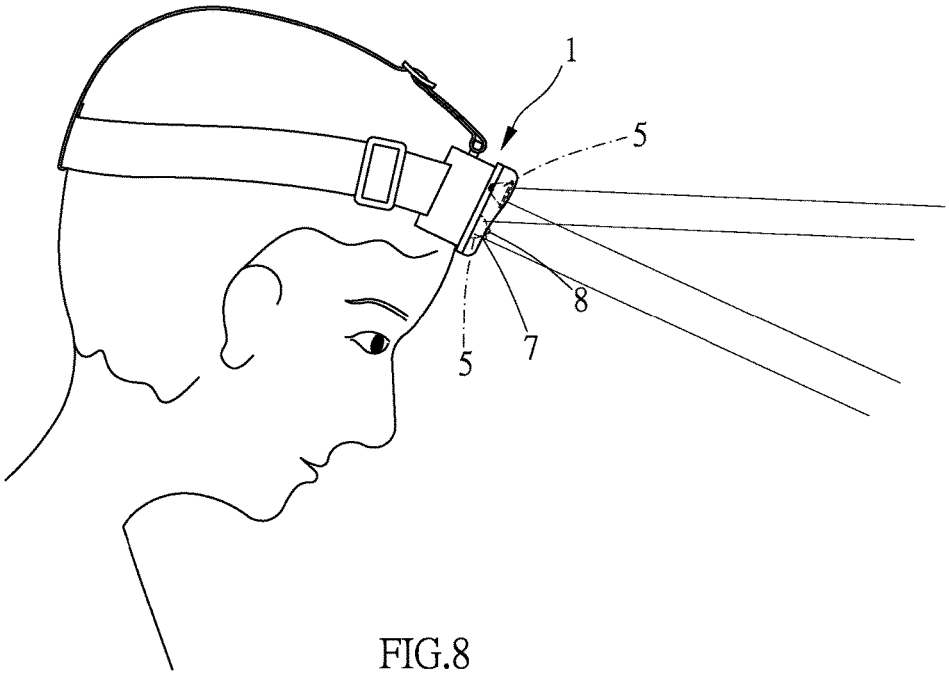
Figure 9:
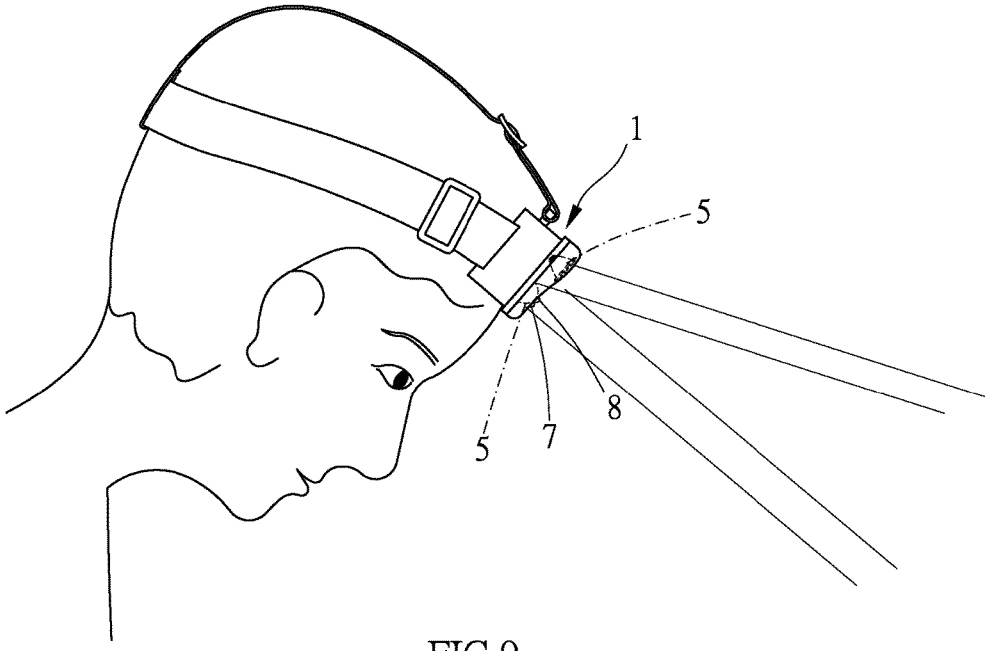

Please reference to FIG. 5, besides general illumination, it may condense or diffuse the lights according to the distance between the lighted object and the head. The head lamp device of this invention further comprises a high-beam detector 7 for detecting a front light source and a low-beam detector 8 mounted at the cover member 1. The high-beam detector 7 and the low-beam detector 8 may be electrically connected with the receiving unit 21 of the main control member 2 wirelessly or wiredly. The high-beam detector 7 and the low-beam detector 8 are detecting the brightness of the light source in front of the head and generating a light-source information 9 to transmit to the receiving unit 21 of the main control member 2 for being received. And the control unit 22 further controls the brightness of the lamps 5 based on the light-source information and then the lights emitted from the lamps are changed to be diffused or condensed. When the front light source is weaker, the lights of the lamps 5 are condensed. When the front light source is stronger, the lights of the lamps 5 are diffused. When the user is reading or seeing the far or nearby object, the head is moved at the lowest position and light source between the lighted object and the head is detected so that the two lamps 5 under the cover member 1 or one of the lamps 5 are lightened and the brightness thereof is adjusted to provide lights for user's reading. There are three lamps 5 for illustration. The upper lamp(s) 5 is TIR (total interface reflection) lens, and the lower lamps 5 may be used as condensing lens and astigmatic lens.

The sensing member 3 may be a gyroscope, a level meter, or a G-sensor. The gyroscope is used as a device for detecting a direction and maintaining in the direction. The gyroscope is mainly composed of a wheel rotatably arranged at the axle thereof. When the gyroscope is working, the gyroscope may resist the change of the direction due to the angular momentum of the wheel. The gyroscope is generally employed in navigation or positioning system and has the features of small volume, light weight, low cost, long service life, low power loss, and digitalizing and intelligentizing with ease. The level meter is generally used for measuring small angle. In Machinery industry and the manufacturing of watches, the level meter is used for detect the inclined angle relative to the horizontal level, the flatness and straightness of the guiding rail of the machine tool equipment, and the horizontal and vertical level for setting the equipment. The G-sensor is the Accelerometer and providing the information of speed and displacement. The accuracy of the G-sensor may be 0.002 rad. The surface angle between the platform and the datum plane and the direction of the surface angle are generated from the pre-programming design and a plurality of sensors for detecting different directions. The above mentioned three different sensing devices may provide to detect the angle of head moving while the cover member 1 is moved with the head and further the lamps 5 may be controlled to turn on or turn off by the control unit 22 precisely and the brightness of each lamps 5 is linear. Besides, preferably each lamp 5 may be LED, but not limited thereto.

In conclusion, the cover member 1 may be worn on the head of the user by the strap 11 and the cover member 1 may be moved with the head so that the sensing member 3 may detect the angle of head moving and the relative information may be generated and provided to the receiving unit 21 of the main control member 2. The receiving unit 21 may transmit the signal 4 to the control unit 21. And the control unit 22 may control each lamp 5 to turn on or turn off and the lights emitted from each lamp 5 to be condensed or diffused according to the signal 4. Besides the efficiency of working in dark is improved, the dangers may be decreased. The cost may be decreased due to the assembly of each lamp 5, the main control member 2, the sensing member 3, the high-beam detector 7, and the low-beam detector 8. It is easy for use to achieve the best illuminating status based on the angle of head moving. That is, the lights may follow the object which the eyes of the user want to see. Compared to the prior art, it is more suitable for the poplar.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A head lamp device for wearing on a head and emitting lights outwardly, comprising:

a cover member;

a main control member, mounted in the cover member, a receiving unit and a control unit are embedded in the main control member, the receiving unit and the control unit are electrically connected with each other wirelessly or wired;

a sensing member, electrically connected with the main control member and installed in the cover member, the sensing member is detecting an inclined angle of the head and generating a signal for being transmitted to the main control member and received by the receiving unit;

at least two lamps, electrically connected with the control unit of the main control member, the lamps are controlled to turn on, turn off, adjust brightness, and change light-on/light-off priority of the at least two lamps by the control unit after the receiving unit of the main control member receives the signal; and a high-beam detector for detecting a front light source and a low-beam detector mounted on the cover member, the high-beam detector and the low-beam detector are electrically connected with the receiving unit of the main control member, the high-beam detector and the low-beam detector are detecting the brightness of the light source in front of the head and generating a light-source information to transmit to the receiving unit for being received, the control unit controls the brightness of the lamps based on the light-source information and then the lights emitted from the lamps are changed to be diffused or condensed;

wherein the sensing member is detecting the change of the inclined angle via moving the head.

2. The head lamp device as claimed in claim 1, wherein the signal is an angle signal.

3. The head lamp device as claimed in claim 1, wherein the sensing member is a gyroscope, a level meter, or a G-sensor.

4. The head lamp device as claimed in claim 1, wherein the lamps are at the same height and arranged in parallel horizontally.

5. The head lamp device as claimed in claim 1, wherein the lamps are arranged in parallel vertically.

6. The head lamp device as claimed in claim 1, wherein at least one strap is connected to the peripheral of the cover member.

7. A head lamp device for wearing on a head and emitting lights outwardly, comprising:

a cover member;

a main control member, mounted in the cover member, a receiving unit and a control unit are embedded in the main control member, the receiving unit and the control unit are electrically connected with each other wirelessly or wired;

a sensing member, electrically connected with the main control member and installed in the cover member, the sensing member is detecting an inclined angle of the head and generating a signal for being transmitted to the main control member and received by the receiving unit; and at least two lamps disposed at the same height and arranged in parallel horizontally, the at least two lamps are electrically connected with the control unit of the main control member, the lamps are controlled to turn on, turn off, adjust brightness, and change light-on/light-off priority of the at least two lamps by the control unit after the receiving unit of the main control member receives the signal, the lamps are;

wherein the sensing member is detecting the change of the inclined angle via moving the head.

* * * * *